US008566174B2

(12) United States Patent
Hale

(10) Patent No.: US 8,566,174 B2
(45) Date of Patent: Oct. 22, 2013

(54) ONLINE AUCTION BIDDING SYSTEM

(75) Inventor: Daniel Eugene Hale, Encinitas, CA (US)

(73) Assignee: Hale Software Concepts, Inc., Encinitas, CA (US)

( * ) Notice: Subject to any disclaimer, the term of this patent is extended or adjusted under 35 U.S.C. 154(b) by 165 days.

(21) Appl. No.: 13/007,275

(22) Filed: Jan. 14, 2011

(65) Prior Publication Data

US 2012/0185346 A1 Jul. 19, 2012

(51) Int. Cl.
*G06Q 30/00* (2012.01)

(52) U.S. Cl.
USPC ..... 705/26.3

(58) Field of Classification Search
USPC ..... 705/26.3
See application file for complete search history.

(56) References Cited

U.S. PATENT DOCUMENTS

| | | | | |
|---|---|---|---|---|
| 3,548,174 | A * | 12/1970 | Knuth | 708/250 |
| 6,665,649 | B1 * | 12/2003 | Megiddo | 705/37 |
| 6,754,741 | B2 * | 6/2004 | Alexander et al. | 710/52 |
| 7,213,000 | B2 * | 5/2007 | Gutierrez et al. | 705/37 |
| 7,283,980 | B2 * | 10/2007 | Alaia et al. | 705/37 |
| 7,315,832 | B2 | 1/2008 | Bauer et al. | |
| 7,599,878 | B2 | 10/2009 | Atkinson et al. | |
| 7,734,505 | B2 * | 6/2010 | Miller et al. | 705/26.3 |
| 7,831,479 | B2 * | 11/2010 | Scargill et al. | 705/26.3 |
| 7,835,944 | B2 * | 11/2010 | Ko et al. | 705/26.3 |
| 7,895,087 | B1 * | 2/2011 | Gottlieb | 705/26.3 |
| 2002/0026400 | A1 * | 2/2002 | Narayan et al. | 705/37 |
| 2005/0080707 | A1 * | 4/2005 | Glasspool | 705/37 |
| 2008/0313089 | A1 * | 12/2008 | Du Preez | 705/80 |
| 2010/0076860 | A1 | 3/2010 | Kaghashvili | |

OTHER PUBLICATIONS

Welch, M., "Santa's Helper," Boston Globe, Third Edition, Business Section, p. E4, Dec. 25, 1997.*

* cited by examiner

*Primary Examiner* — Nicholas D Rosen
(74) *Attorney, Agent, or Firm* — Mark K. Young, Esq.; Mayer & Williams PC

(57) ABSTRACT

An online auction bidding system utilizes a three state auction model that includes an auction open state, followed by a closing state, and an auction closed state which occurs last in which the online auction is ended and bids will not be accepted. The highest bid received prior to the auction end is considered the winning bid. In the auction open state, bids are guaranteed to be accepted if they are qualified, for example, by meeting certain conditions such as being above a current high bid by some desired increment. The closing state is of indeterminate length and thus the time that the online auction ends is unknown by the bidders which makes the practice of sniping difficult. Qualified bids are accepted during the closing state but bidders run the risk that a later bid will not be accepted should the auction end prior to that bid being placed.

5 Claims, 9 Drawing Sheets

ONLINE AUCTION BIDDING SYSTEM

BACKGROUND

Online auctions are a popular way for participants to bid for products and services (collectively referred to as "items") over the Internet. Online auction sites such as eBay, uBid, OnlineAuction, eBid, and others commonly employ a system in which some individual online auctions are held for a fixed duration and end at a specific time that is known in advance to the participants. The bidder who has placed the highest bid at the time the online auction ends is the winner.

Some online auction sites employ automatic or "proxy bidding" where an online auction bidder specifies the maximum bid amount that he or she is willing to pay for an item. Automated systems at the online auction website will place bids on the bidder's behalf typically using a predetermined incremental amount over the current high bid. As other bids come in on the item, the automated proxy bidding system will continue to place bids for the bidder up to the specified maximum. The bidder's maximum bid is kept confidential until it exceeded by another bidder. Proxy bidding makes it convenient to participate in an online auction without participants having to watch online auctions and come back to re-bid every time someone places a higher bid and thus encourages the online auction participant to specify the maximum amount they are willing to pay for an item.

Fixed duration online auctions are susceptible to a practice called "sniping" in which a bidder jumps in and places the highest bid very close to the online auction's end time so that there is not enough time for other bidders to increase their bids beyond their specified maximum. Although sniping advocates point out that the sniper only wins the auction if he or she is willing to pay more for the item than the other bidders, sniping draws complaints from both online auction buyers and sellers alike. Some online auction buyers dislike sniping because they find it frustrating to place a bid and then patiently wait for an online auction to end only to have the item get snatched away at the last second. Buyers may also feel that it is unfair that they do not get another chance to bid after seeing and evaluating the other higher bid. Some buyers have expressed a desire to know what other bidders are willing to pay and be given a chance to place a higher bid as is common in regular live auctions where the auctioneer provides opportunities to place final bids by saying "going once, going twice, . . . gone" before ending the auction with a bang of the gavel. Some sellers of items on an online auction site also dislike sniping because they believe it lowers the price that they might otherwise receive for items if buyers could get caught up in the excitement and frenzy of the online auction. Sniping may be viewed by sellers as a practice that precludes the possibility for buyers to drive up the item price as they attempt to outbid each other.

This Background is provided to introduce a brief context for the Summary and Detailed Description that follow. This Background is not intended to be an aid in determining the scope of the claimed subject matter nor be viewed as limiting the claimed subject matter to implementations that solve any or all of the disadvantages or problems presented above.

SUMMARY

An online auction bidding system utilizes a three state auction model that includes an auction open state, followed by a closing state, and an auction closed state which occurs last in which the online auction is ended and bids will not be accepted. The highest bid received prior to the auction end is considered the winning bid. In the auction open state, bids are guaranteed to be accepted if they are qualified, for example, by meeting certain conditions such as being above a current high bid by some desired increment. The closing state is of indeterminate length and thus the time that the online auction ends is unknown by the bidders which makes the practice of sniping difficult. Qualified bids are accepted during the closing state but bidders run the risk that a later bid will not be accepted should the auction end prior to that bid being placed.

In various illustrative examples, the end time for the auction open state and the latest possible end time for the auction are published to the online auction participants. The length of the closing state may be selected as a random percentage of the time interval between the end of the auction open state and the latest possible auction end time. The closing state may also be extended, and the auction end delayed so long as the time between qualified bids does not exceed a predetermined or randomly determined time interval. The closing state may also be divided into periods including, for example, a first period in which the closing state is extended so long as the time between successive qualified bids does not exceed the interval. If the auction is still not closed at the end of the first period, then during a second period the closing state terminates at a random time to end the auction regardless of the bid timing. The time dividing line between the first and second periods may be chosen at random.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DESCRIPTION OF THE DRAWINGS

Like reference numerals indicate like elements in the drawings. Elements are not drawn to scale unless otherwise indicated.

DETAILED DESCRIPTION

Figure 1:
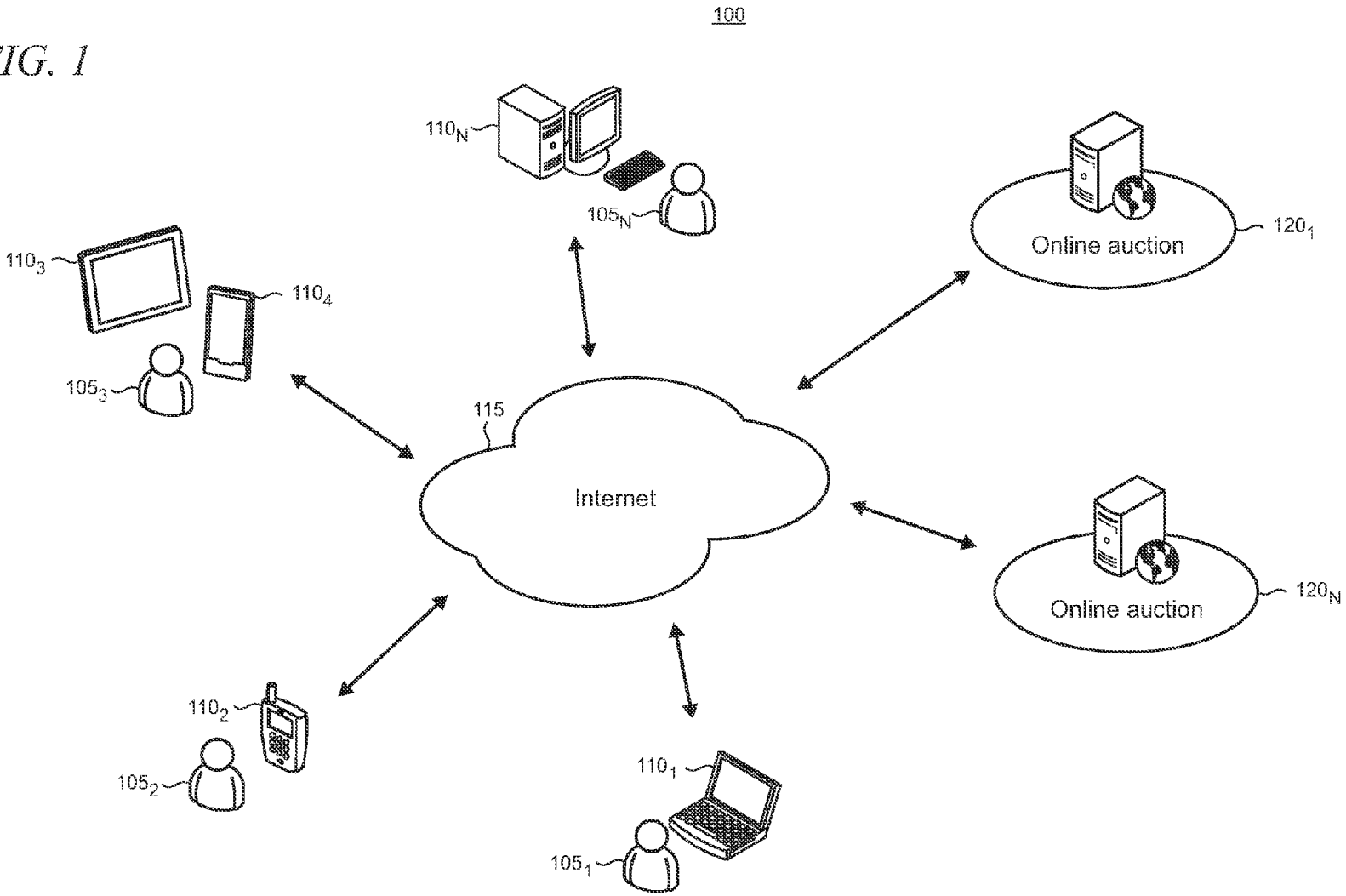
FIG. 1 shows an illustrative online auction environment in which auction participants at various types of computing platforms access online auction websites over the Internet.

FIG. 1 shows an illustrative computing environment 100 in which the present online auction bidding system may be implemented that includes a number of users $\mathbf{105}_{1,2\ldots N}$ interacting with respective computing platforms $\mathbf{110}_{1,2\ldots N}$. The computing platforms 110 may, in this illustrative example, include any of a variety of devices with data communications capabilities such as desktop and laptop PCs, game consoles, mobile phones, smart phones, personal e-mail devices, personal media players, personal digital assistants, GPS (Global Positioning System) devices, tablet computers, digital cameras, and the like.

As shown, the users 105 may communicate among each other and interact with various services and websites on the World Wide Web using public network infrastructure such as the Internet 115. The services/websites in this illustrative example include various online auction sites $\mathbf{120}_{1 \ldots N}$. The online auction sites 120 may employ a variety of automated systems that facilitate sellers listing items on auction sites that are available for sale in auctions and buyers placing bids for the items in respective online auctions. The users 105 will typically interact with online auction sites 120 utilizing a user interface that is supported by a web browser that is implemented using software code that is stored on various computer-readable storage media and executed using one or more processors in a computing platform.

Figure 2:
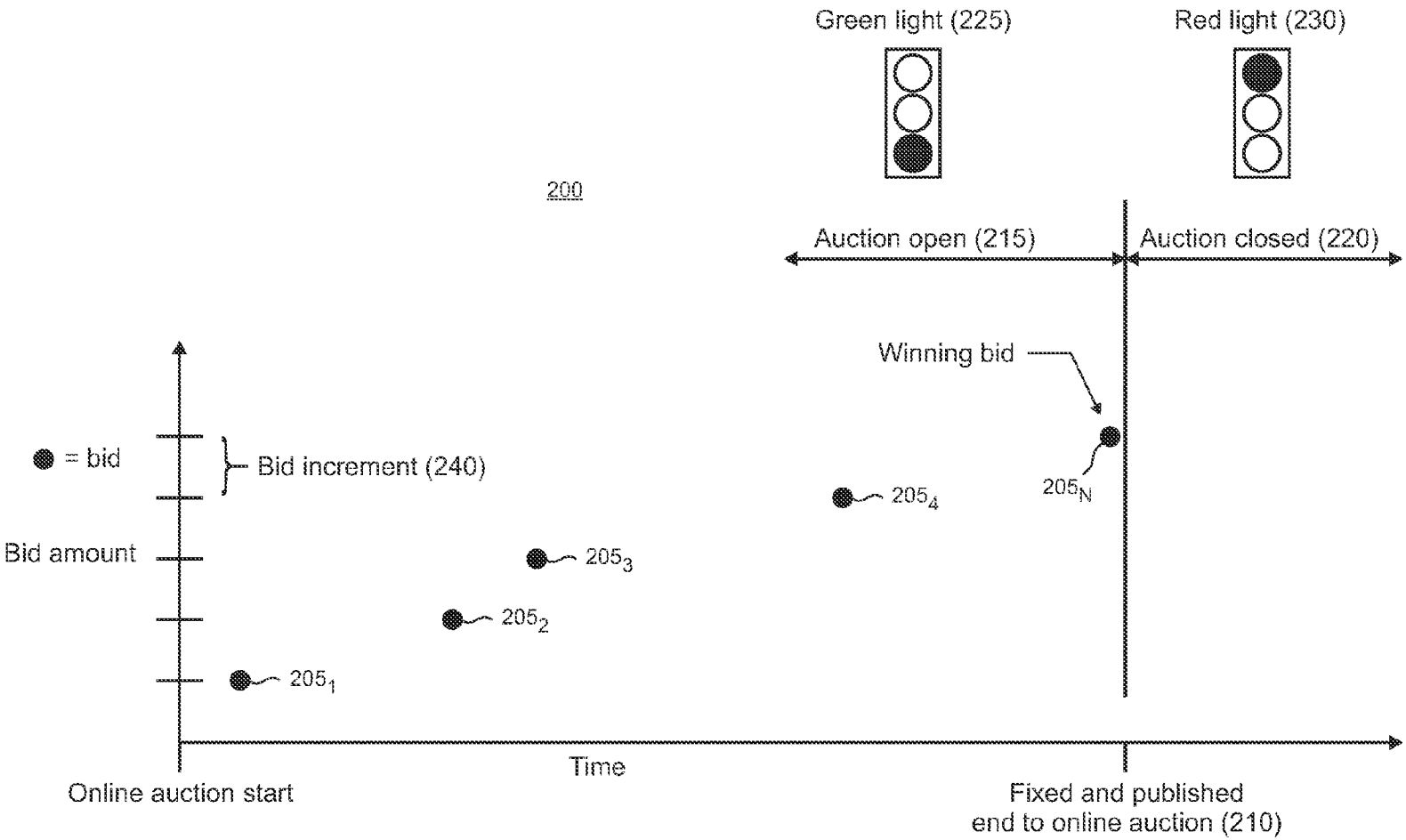
FIG. 2 shows an illustrative bidding timeline used by some current online auctions.

While auction rules and procedures can vary among the online auction sites 120, a typical auction timeline 200 is shown in FIG. 2. The timeline 200 plots bid amount (for example, in dollars) against time and shows a succession of bids $\mathbf{205}_{1,2 \ldots N}$ placed by various bidders (e.g., the users 105 in FIG. 1) over the duration of the online auction. As indicated by reference numeral 210, the online auction in FIG. 2 ends at a fixed point in time that is published and can be known by the seller, the bidders, and the personnel (e.g., online auction administrator) and systems associated with the site that is hosting the particular online auction. Accordingly, the auction may be characterized as having two states: an auction open state in which bids can be received, and an auction closed state in which no further bids are accepted, as respectively indicated by reference numerals 215 and 220. The highest bid received during the open state before the online auction ends and goes into the closed state is considered the winning bid, which in this illustrative example is bid $\mathbf{205}_N$. The bidder placing the winning bid is declared the online auction winner. The different auction states may be conveniently described using a traffic light metaphor. In the conventional online auction depicted in FIG. 1, the open state is like an intersection controlled by a green light where a driver is free to proceed (i.e., a bidder can place a bid). The closed state is like an intersection controlled by a red light where the driver is not free to proceed (i.e., the bidder cannot place a bid). The green light and red light are respectively indicated by reference numerals 225 and 230.

The bids 205 are shown in FIG. 1 as being received by systems at the online auction site at arbitrary times and are intended to be illustrative only. Typically, a minimum amount—called a bid increment—by which a successive bid raises the current price is utilized. The bid increment is shown in FIG. 1 by reference numeral 240. A later bidder must typically bid at least the bid increment over the maximum bid of an earlier bidder in order for that later bidder's bid to be valid and accepted by the system. The bid increment can vary in conventional online auctions and is typically predetermined by the online auction rules based on the current high bid. Bidders can bid over the bid increment and the online auction can increase a bid over the increment to beat a competing bidder's maximum bid using proxy bidding.

Under common online auction rules, it may be possible for a bidder to be outbid by less than a full bid increment and a winning bidder's maximum bid typically only needs to exceed the next highest maximum bid by a small amount (for example, one cent). For example, if a first bidder specifies a maximum bid of $20.00 for an auctioned item, an automated online auction system will typically bid on the bidder's behalf up to $20.00 against the other bidders in the online auction. Thus, when a second bidder places a maximum bid of $9.00, the first bidder's bid is automatically raised to $9.50 (where 50 cents is the bid increment in this example). When a third bidder places a maximum bid $20.01 which is above the current high bid by more than the bid increment, that third bidder becomes the high bidder at $20.01 as that bid is above the first bidder's maximum bid of $20.00. The third bidder would have the winning bid of $20.01 at the end of the online auction if the first bidder does not come back and raise his or her maximum bid or another bidder comes in with a higher bid.

As shown in FIG. 1, the winning bid $\mathbf{205}_N$ was received close to the end 210 of the online auction. A winning bid can be placed minutes or even seconds before the auction end in some instances. As noted above, this practice is termed "sniping" and bidders who use it typically try to minimize the amount of time remaining in the online auction after bidding so that other bidders are prevented from responding with higher maximum bids before the online auction ends (and thus enters the red light state). A bidder may perform sniping manually by observing the online auction on his or her computer as it nears its published end time and placing a bid close to the end. Alternatively, sniping can be performed in an automated manner using software that can execute, for example, on a local computing platform or as a web application. The bidder can specify a particular online auction and item to bid on, along with a maximum bid, and the sniping software will connect to the online auction at an appropriate time near the auction end to place the bids automatically for the bidder.

Figure 3:
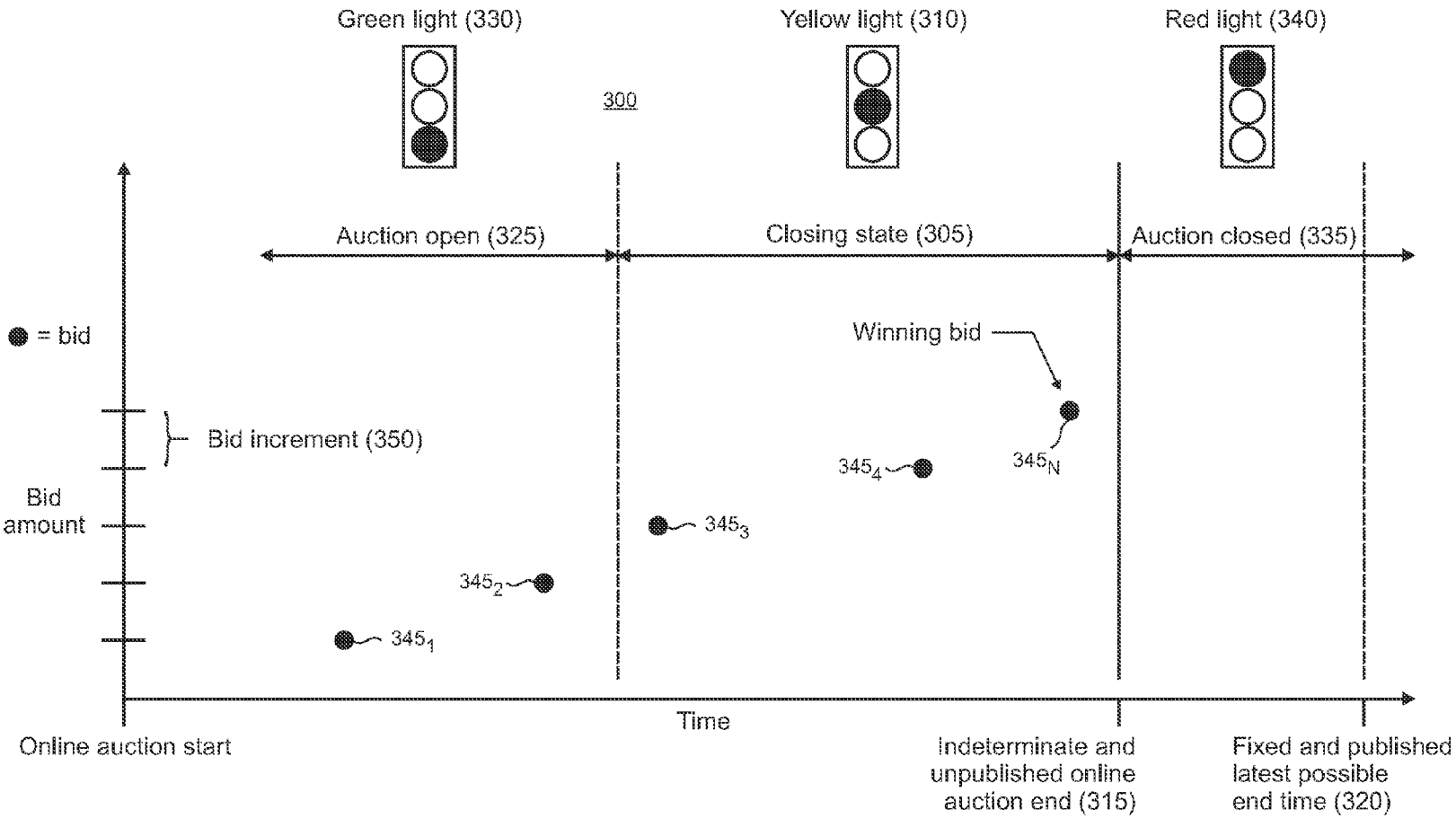
FIG. 3 shows an illustrative timeline that depicts implementation of the present online auction bidding system.

FIG. 3 shows an illustrative timeline 300 that depicts implementation of the present online auction bidding system that is designed to make it difficult to practice sniping. This online bidding system introduces the concept of a third state termed a "closing state" to the timeline rather than just utilizing a set of binary states as with conventional online auctions (i.e., green light or red light). The closing state is analogous to a yellow traffic light at an intersection that warns a driver that the intersection is still open but that a red light is forthcoming and the intersection will be closed to the driver.

During the closing state 305 (i.e., yellow light 310), bids will still be accepted, but the length of the closing state duration is not determined in advance (i.e., is indeterminate). Accordingly, the actual end time for the present online auction depicted in timeline 300 is unpublished and is unknowable by the item seller and the bidders, unlike a conventional online action. This indeterminate and unpublished online auction end is indicated by reference numeral 315 in FIG. 3. A fixed, latest possible online auction end time 320 is published, by contrast, and is thus knowable by the bidders, item seller, etc. The online auction will end no later than the latest possible end time, but could end sooner. Knowing the latest possible end time may help, for example, bidders to select which items to bid on or come back to the site at an appropriate time to check on the status of a given auction to see if they have won or lost.

Because the length of the closing state 305 is not known by any of the bidders, the only state in which a bidder is guaranteed to be able to place a bid is the open state 325 (i.e., during a green light 330) assuming the bid is qualified, for example by meeting other criteria such as the specified maximum bid being higher by the bid increment over the current high bid. In other words, during a yellow light 305, bidders can still place bids, but risk having an online auction be closed at a red light if they attempt to place the bid at a later time. In the timeline 300, the auction closed state and red light are respectively indicated by reference numerals 335 and 340. The indeterminate nature of the end of the closing state means that both human bidders and automated sniping software will be unable to place bids just prior to the online auction end 315 except by luck.

Figure 4:
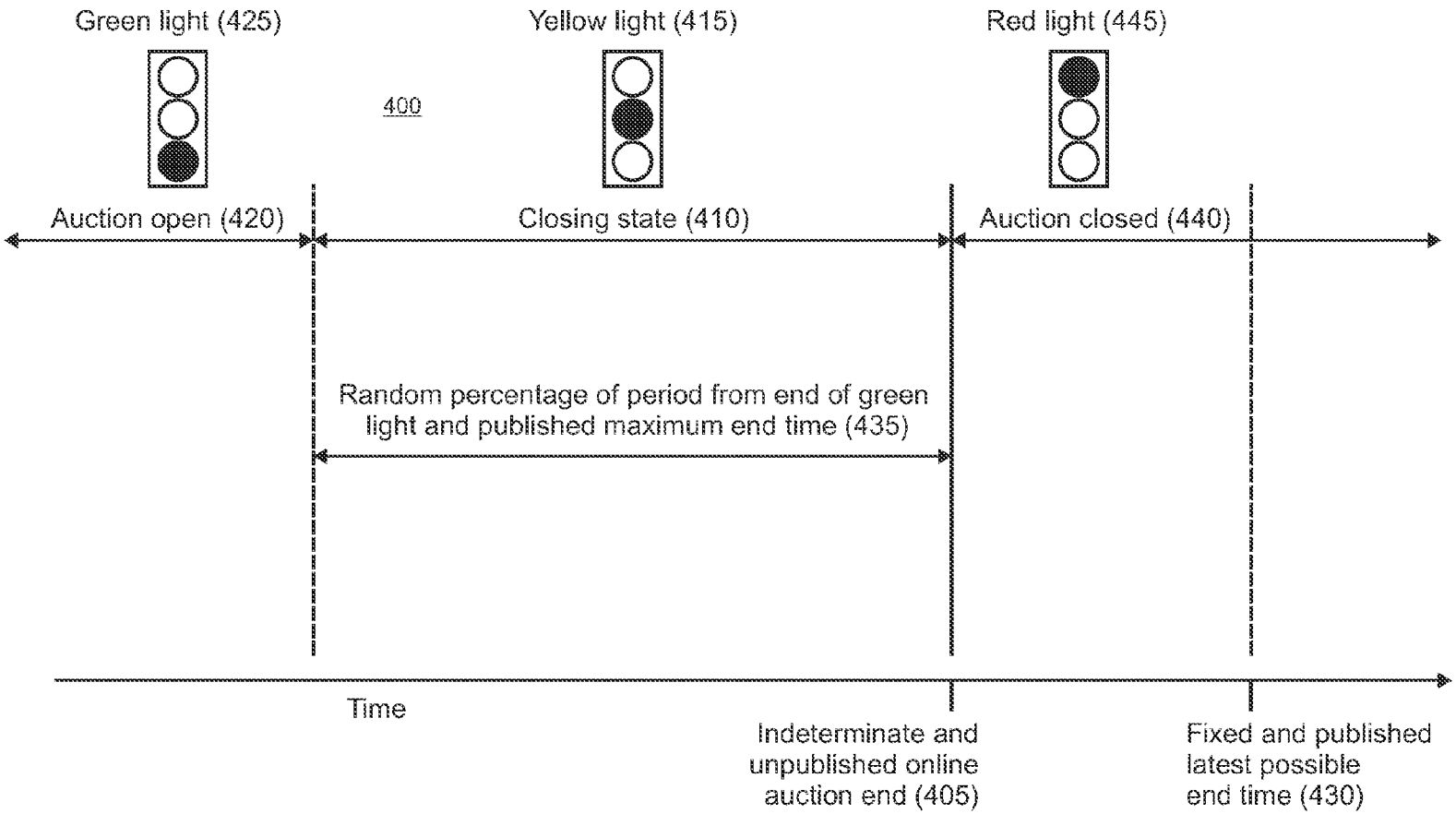
FIG. 4 shows an illustrative timeline in which the end for an online auction is chosen randomly.
Figure 5:
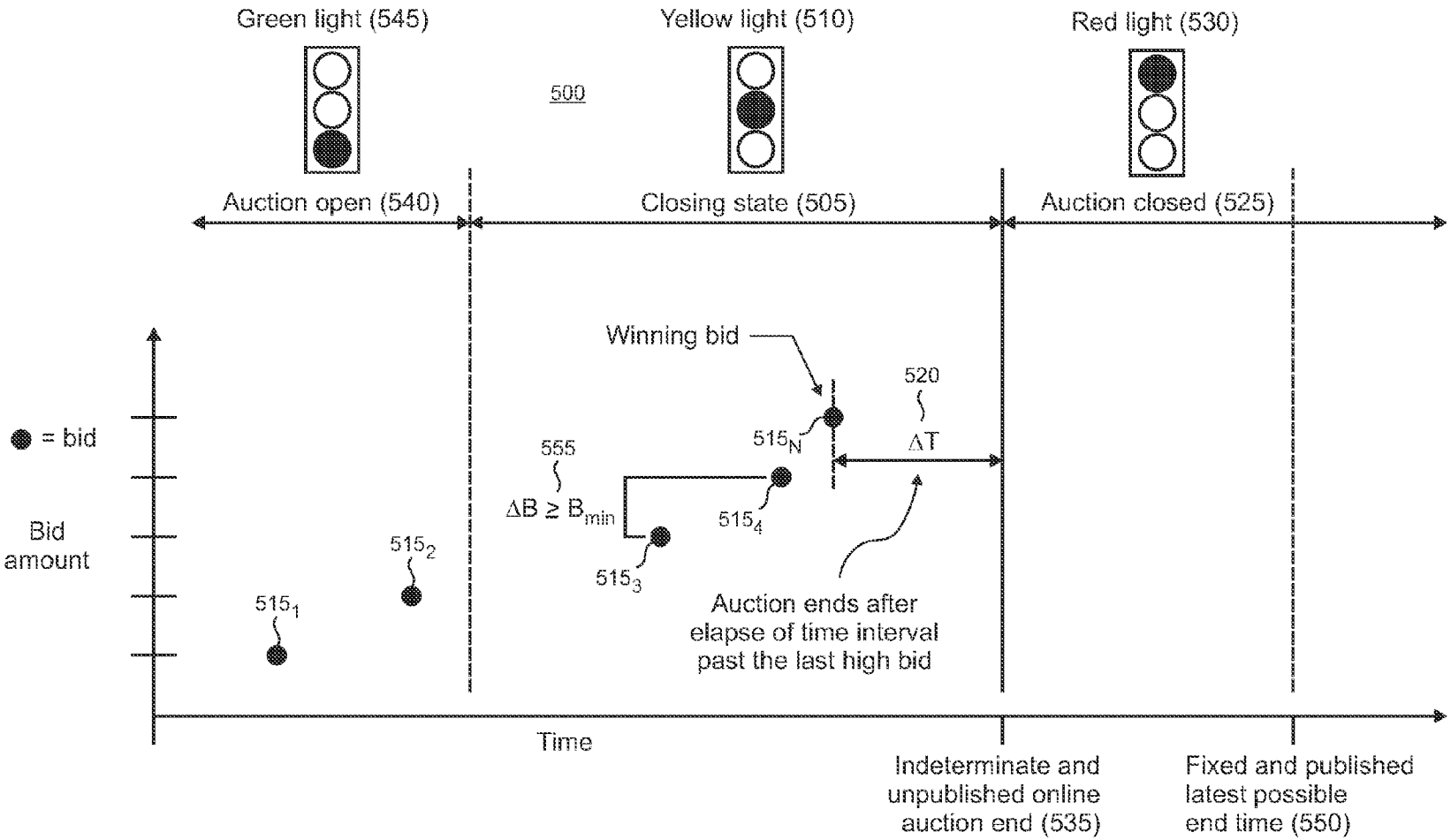
FIG. 5 shows an illustrative timeline in which the closing state ends upon the elapse of a time interval past the last bid.
Figure 6:
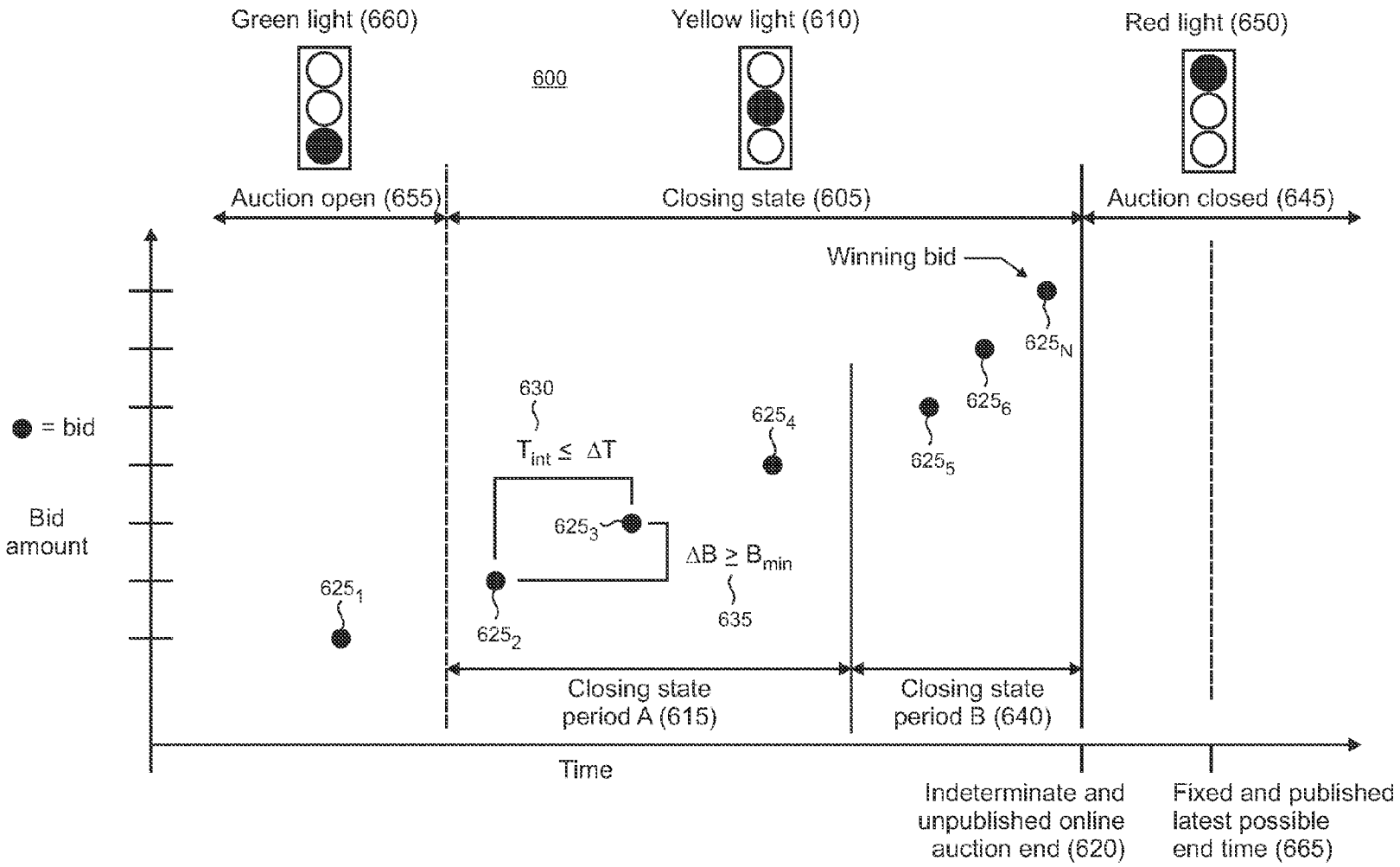
FIG. 6 shows an illustrative timeline having a closing state that is separated into periods in which the end of the online auction is delayed so long as bids are being placed within some time interval in the first period and the end of the auction is chosen randomly in the second period.

Bids $\mathbf{345}_{1,2 \ldots N}$ are placed by various bidders (e.g., the users 105 in FIG. 1) over the duration of the auction and the automated systems used by the online auction site will increase the bids in bid increments 350 up to the bidder's specified maximum. As shown, some of the bids 345 are placed in the open state 325 during the green light 330 and others are placed in the closing state during the yellow light 310. The highest bid received in the closing state 305 during the yellow light 310 is considered the winning bid, which in this illustrative example is bid $\mathbf{345}_N$. It is emphasized that the bids shown in this timeline and those in FIGS. 4, 5, and 6 are intended to be illustrative and that the bid amounts, increments, and timing can vary from what is depicted. For example, in some auctions all of the bids might be placed in the open state 325 during the green light 330 and in other auctions all of the bids may be placed in the closing state 305 during the yellow light 310.

Different algorithms and methods may be utilized to choose the indeterminate and unpublished online auction end time. FIG. 4 shows application of an illustrative algorithm in which the end time 405 of an online auction in a timeline 400 is chosen randomly. That is, the length of the closing state 410 during the yellow light 415 may be selected as some randomly-chosen percentage of the time interval from the end of the auction open state 420 during the green light 425 and the fixed and published latest possible end time 430, as indicated by reference numeral 435. In typical applications of the present bidding system the end of the green light 425 and beginning of the yellow light 415 may be set in advance and the transition time published to the online auction participants (e.g., bidders and item seller). In other applications, the transition from green light to yellow light can be unpublished and/or be selected randomly.

The random numbers that are typically utilized by this illustrative algorithm can be selected using a true random number generator such as one that is implemented in physical electronics (i.e., hardware) or using pseudo-random numbers that may be selected using a software-based pseudo-random generating algorithm. For example, an additive generator proposed by D. E. Knuth using infinite (or very large) periodicity can produce pseudo-random numbers that may be expected to result in satisfactory randomness to be implemented for the end time 405. A shuffle buffer may also be utilized in combination with the Knuth additive generator to further increase the periodicity if it is not infinite. Empirical results have demonstrated more than a trillion pseudo-random values without repeat using this technique.

At the randomly chosen end of the yellow light 415, the online auction enters the auction closed state 440 during a red light 445. In this closed state, as with a conventional online auction, no further bids are accepted. The highest bid placed before the auction end 405 is considered the winning bid.

FIG. 5 shows an illustrative timeline 500 employing an algorithm with which the closing state 505 under the yellow light 510 ends upon the elapse of a time interval ΔT past the last bid $\mathbf{515}_N$, as indicated by reference numeral 520. The time interval 520 can be specified in some applications of the present bidding system by an online auction system administrator. For example, the interval could be set at 30 seconds and if no further bids are placed after the last bid within that interval, the online auction enters the auction closed state 525 during a red light 530 and no further bids are accepted. In some applications, the time interval 520 may be selected randomly, within lower and upper bounds in most cases, using a random number generator or pseudo-random generation algorithm as described above.

As with the algorithm applied to the timeline shown in FIG. 4, the online auction end 535 is indeterminate because it is not possible to know the end until the time it occurs. With this algorithm, the online auction end 535 may occur randomly if the time interval 520 is randomly selected. However, even in cases when the time interval is predetermined, the online auction end 535 will still occur unpredictably in most applications because the end is at least partially dependent on the behaviors of a number of bidders. The diversity of behaviors in the pool of bidders may typically be expected to be large enough to enable the end of the online auction to approach a level of unpredictability that would be achieved using a purely random algorithm.

As with the timelines 300 and 400 shown respectively in FIGS. 3 and 4, bids are guaranteed to be accepted in the auction open state 540 during the green light 545 assuming they are qualified bids. A fixed latest possible end time 550 may be utilized and published so that bidders know when to come back to check on the online auction results.

In some implementations, the algorithm applied to the timeline 500 may be adapted so that bids accepted by an online auction system are only those that equal or exceed some threshold amount over a previous high bid. That is AB $>B_{min}$, as indicated by reference numeral 555. $B_{min}$ can be the same as the bid increment, but it does not necessarily have to be the same. As noted above, some online auction rules can be applied to particular bidding behavior that can result in a bidder being outbid by an amount smaller than the bid increment (e.g., the winning bid needs to exceed the previous high bid by as little as one cent in many online auctions). The threshold bid amount 555 can be imposed to prevent the online auction from being "gamed" by bidders or automated software that bids in a way that increases the high bid in small amounts in order to keep the auction alive in an attempt to extend the closing state/yellow light indefinitely.

FIG. 6 shows an illustrative timeline 600 in which the closing state 605 during the yellow light 610 is separated into two or more periods. In this example, the closing state 605 is separated into two periods, although it is noted that more than two periods may be utilized in some applications. In this illustrative example, the time dividing line between the periods may be selected randomly. In the first period—closing state period A as indicated by reference numeral 615—the closing state 605 is extended and the end 620 of the online auction is delayed so long as bids 625 are being placed within some time interval $T_{int} \leq \Delta T$ as indicated by reference numeral 630, where ΔT may be set, as with the above example, by an online auction system administrator or selected randomly within some lower and upper bounds. In some applications, bids may also only be accepted if they equal or exceed a threshold $\Delta B \geq B_{min}$, as indicated by reference numeral 635.

If the closing state has not been terminated in the first closing state period A, then in the second period—closing state period B as indicated by reference numeral 640—the closing state 605 is terminated randomly and the online auction ends. In the closing state period B 640, the auction end 620 can occur regardless of the bid timing in the period and/or without concern for a minimum bid threshold $B_{min}$. When the online auction enters the auction closed state 645 during a red light 650 no further bids are accepted. As with the examples above, bids are guaranteed to be accepted in the auction open state 655 during the green light 660 assuming they are qualified. A fixed latest possible end time 665 may be utilized and published so that bidders know when they can come back to check on auction results.

Figure 7:
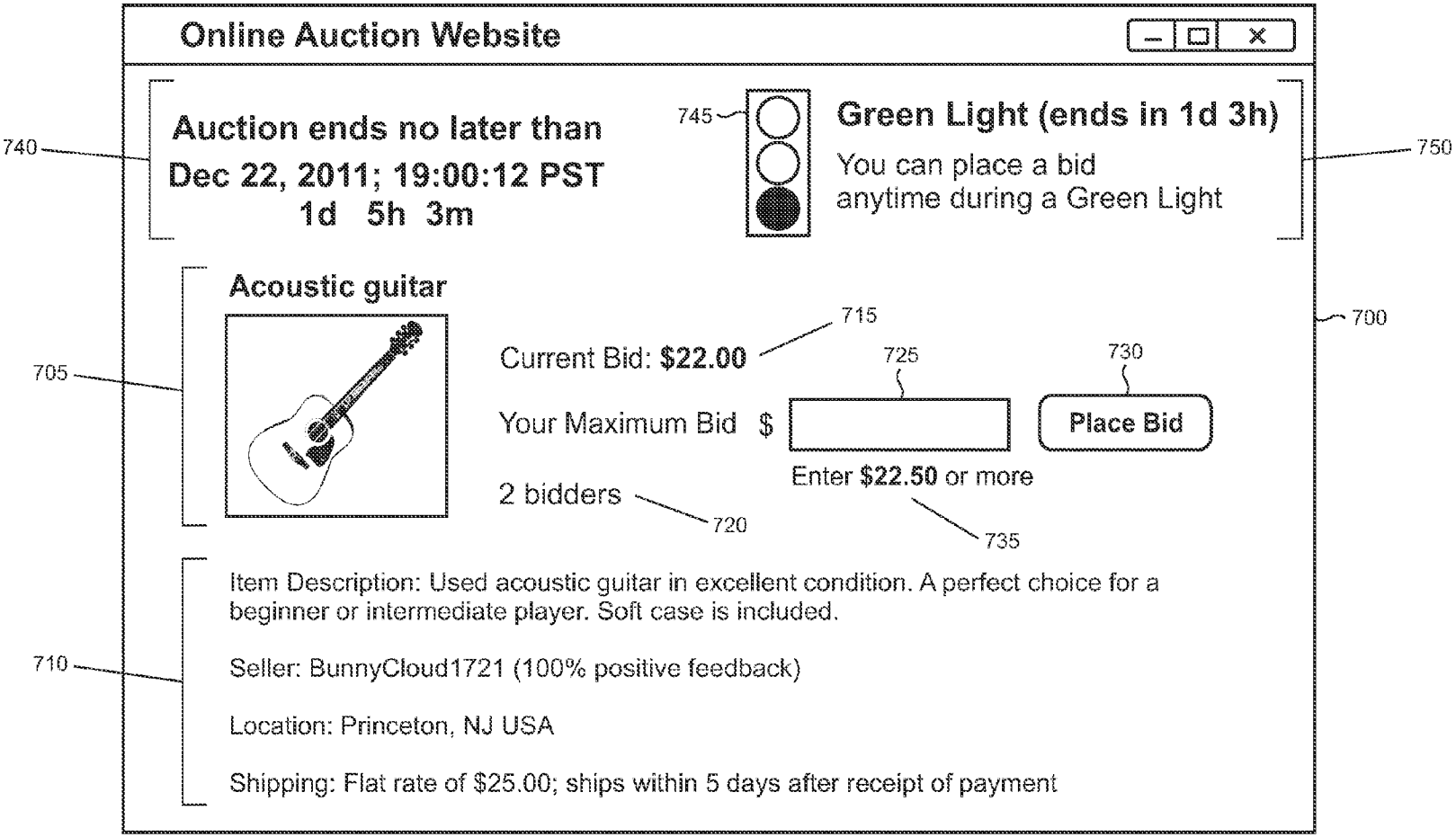
FIGS. 7, 8, and 9 depict various screens supported by an illustrative user interface to an online auction website.

FIG. 7 depicts a screen 700 supported by an illustrative user interface to an online auction website (e.g., one of the online auction sites 120 in FIG. 1) that can facilitate implementation of the present online auction bidding system. The user interface typically runs in a web browser on a computing platform (e.g., computing platforms 110 in FIG. 1). While the particular user interface can vary by site and differ from what is shown, it will typically display an item for sale 705 and include descriptive information and other data (collectively identified by reference numeral 710) that may help bidders decide whether to bid on the item.

Screen 700 further shows a current high bid 715 and the number of bidders 720 who have placed bids. A numeric entry box 725 and entry button 730 are provided in the user interface to enable a bidder to place a bid. In this illustrative example shown in screen 700, the bid increment is 50 cents, as shown by reference numeral 735. A fixed latest possible end time 740 for the online auction is also displayed in the user interface that shows the date/time of the end and the time remaining from the current time to the end.

A graphical representation of the traffic light metaphor is also displayed by the user interface in this illustrative example. In screen 700, the online auction is currently in the open auction state and has a green light icon 745. Descriptive text 750 accompanies the icon to inform and/or remind the bidder that bids can be placed anytime during a green light and further lets the bidder know when the green light is going to end.

Figure 8:
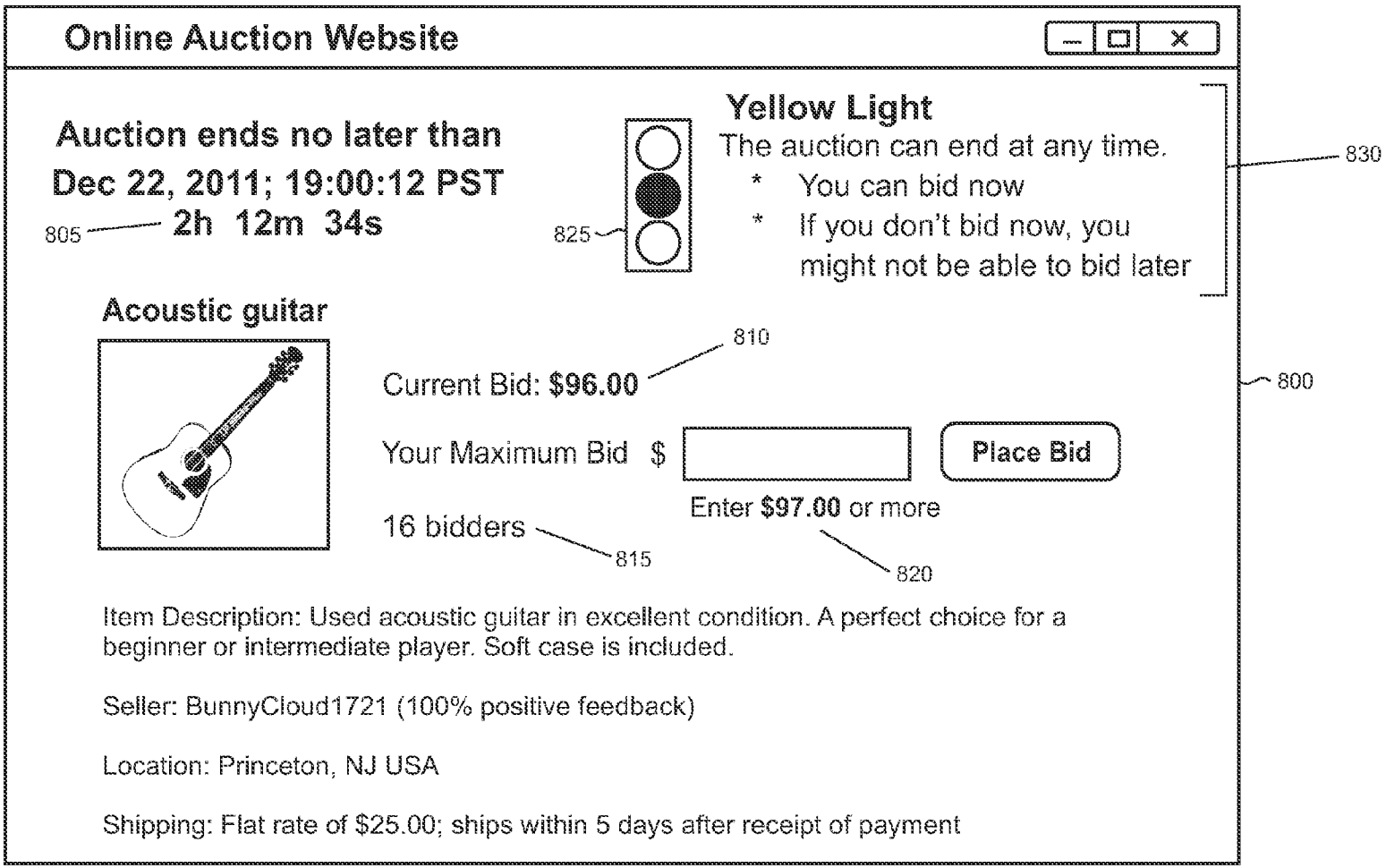

FIG. 8 depicts a screen 800 supported by the illustrative user interface to the online auction for the guitar shown in FIG. 7 at a later time as indicated by the time remaining 805 to the latest possible end time of the online auction. At this later point in time, the current high bid 810 and number of bidders 815 have increased. The bid increment 820 has also increased as it is based on the current high bid in this illustrative example. FIG. 8 also shows that the online auction has a yellow light, as graphically represented to the bidders with a yellow light icon 825. Descriptive text 830 accompanies the icon to inform and/or remind the bidders that they can place a bid during the current yellow light but might not be able to place a bid later.

Figure 9:
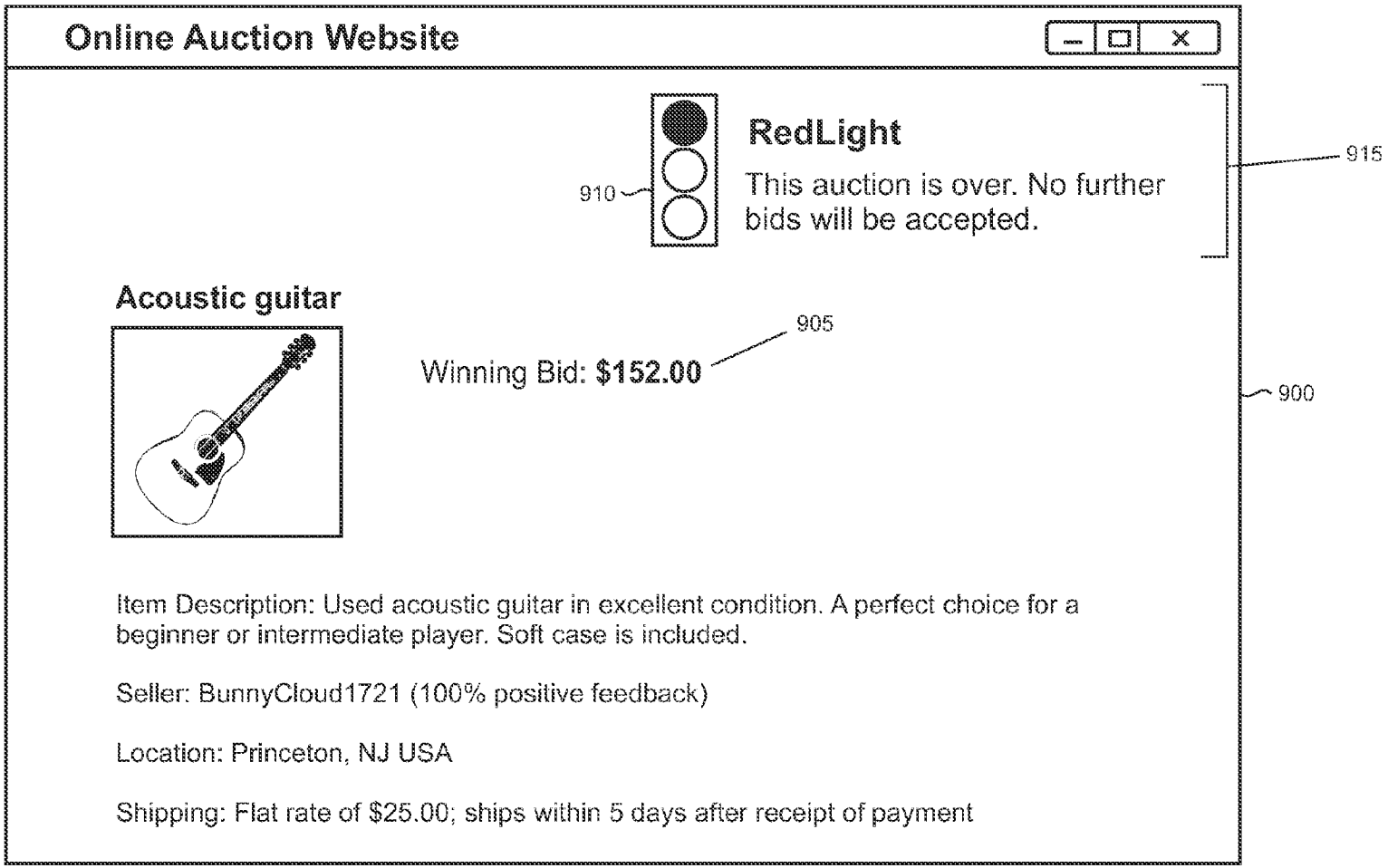

FIG. 9 depicts a screen 900 supported by the illustrative user interface to the online auction for the guitar shown in FIGS. 7 and 8 when the auction is in the closed state during a red light. The user interface shows the winning bid 905 which is the highest bid placed at the time the closing state/yellow light ends and the auction end state/red light begins. A red light icon 910 is displayed to the bidder with accompanying descriptive text 915 to let the bidder know that the online auction is over and that no further bids will be accepted.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A computer-implemented method for selling an item on the Internet, the method comprising:

accepting a listing for the item from a seller;

showing the listing on an online auction supported by a website that is accessible from the Internet;

implementing a three state auction model for conducting the online auction, the three state auction model including an auction open state having a fixed time duration in which the online auction is open for accepting bids for the item, an auction closed state in which the online auction is ended and no bids are accepted for the item, and a closing state having an indeterminate time duration in which bids are accepted for the item, the auction open state being first in time, followed by the closing state, and the auction closed state being last; and declaring a winner for the online auction when ended in the auction closed state, the winner having placed a bid with a highest value in the closing state; and dividing the closing state into periods, a first period being extended in time so long as a length of time between successive bids does not exceed a given time interval and ending the closing state if the length of time exceeds the given time interval, in which a second period is implemented if the closing state has not ended, the second period having a randomly selected duration, at least one of the implementing, declaring, and dividing steps being performed by at least one computer.

2. The computer-implemented method of claim 1 in which the given time interval is predetermined.

3. The computer-implemented method of claim 1 in which the given time interval is random.

4. The computer-implemented method of claim 1 in which a division between the first period and second period is selected randomly.

5. The computer-implemented method of claim 1 including a further step of accepting a bid in the first period only if it is higher in value over a previous bid by a predetermined increment.

* * * * *